US009417599B2

(12) United States Patent
Ju et al.

(10) Patent No.: US 9,417,599 B2
(45) **Date of Patent: *Aug. 16, 2016**

(54) IMAGE FORMING APPARATUS

(71) Applicant: SAMSUNG ELECTRONICS CO., LTD., Suwon-si, Gyeonggi-do (KR)

(72) Inventors: Jeong Yong Ju, Suwon-Si (KR); Jun Ho Lee, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/869,163

(22) Filed: Sep. 29, 2015

(65) Prior Publication Data

US 2016/0018781 A1 Jan. 21, 2016

Related U.S. Application Data

(63) Continuation of application No. 14/030,772, filed on Sep. 18, 2013, now Pat. No. 9,182,736.

(30) Foreign Application Priority Data

Oct. 25, 2012 (KR) ..... 10-2012-0119350

(51) Int. Cl.
*G03G 21/16* (2006.01)

(52) U.S. Cl.
CPC ..... *G03G 21/1647* (2013.01); *G03G 21/168* (2013.01); *G03G 21/1623* (2013.01); *G03G 2221/1684* (2013.01)

(58) Field of Classification Search
None
See application file for complete search history.

(56) References Cited

U.S. PATENT DOCUMENTS 9,182,736 B2 * 11/2015 Ju ..... G03G 21/168
2007/0297835 A1 12/2007 Ikeda
2011/0097110 A1 4/2011 Takeshita

OTHER PUBLICATIONS

Office Action dated Sep. 10, 2014 from U.S. Appl. No. 14/030,772.
Notice of Allowance dated Mar. 4, 2015 from U.S. Appl. No. 14/030,772.
Notice of Allowance dated Jun. 23, 2015 from U.S. Appl. No. 14/030,772.
U.S. Appl. No. 14/030,772, filed Sep. 18, 2013, Jeong Yong Ju, Samsung Electronics Co., Ltd.

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

An image forming apparatus including a body provided at one side thereof with an opening, a transfer device movably installed at the body so as to be detachable through the opening, and a locking lever rotatably installed at the transfer device, wherein the locking lever rotates between a first position at which one end of the locking lever protrudes from the transfer device and a second position at which the one end is accommodated within the transfer device, and the body includes a locking protrusion that is locked with other end of the locking lever in a state that the locking lever is at the first position, so that only in a state that a worker rotates the locking lever while gripping the transfer device, the transfer device is separated from the body, thereby separating the transfer device in a safe manner.

20 Claims, 15 Drawing Sheets

IMAGE FORMING APPARATUS

CROSS-REFERENCE TO RELATED APPLICATIONS

This application is a continuation of U.S. patent application Ser. No. 14/030,772, filed on Sep. 18, 2013, which is currently pending and claims the priority benefit of Korean Patent Application No. 10-2012-0119350, filed on Oct. 25, 2012 in the Korean Intellectual Property Office, the disclosures of each of which are incorporated herein by reference in their entirety.

BACKGROUND

1. Field

Embodiments of the present disclosure relate to an image forming apparatus having a transfer device to transfer toner to a printing medium from a plurality of developing units.

2. Description of the Related Art

An image forming apparatus represents an apparatus designed to form an image on a printing medium, and includes a printer, a copy machine, a facsimile, and a multi-functional device having the functionalities of the printer, the copy machine, and the facsimile.

An image forming apparatus includes a body provided at one side thereof with an opening, and a side cover rotatably installed at the body to open and close the opening. The body is provided at an inside thereof with a plurality of developing units to develop electrostatic latent images to visible images through toners according to colors, an exposure device to form an electrostatic latent image on a photoconductor of each of the developing units by irradiating light onto the photoconductor of the developing units, a transfer device to transfer the visible image developed on the photoconductor to the printing medium, and a fusing device to fix the toner to the printing medium.

In addition, the transfer device is movably installed at the body so as to be separated from the body through the opening.

SUMMARY

Therefore, it is an aspect of the present disclosure to provide an image forming apparatus capable of separating a transfer device from a body in a safe manner.

It is an aspect to provide an image forming apparatus capable of preventing a sensing unit from making friction with a transfer device when the transfer device is separated or installed.

Additional aspects of the disclosure will be set forth in part in the description which follows and, in part, will be obvious from the description, or may be learned by practice of the disclosure.

In accordance with an embodiment, an image forming apparatus includes a body, a transfer device and at least one locking lever. The body may be provided at one side thereof with an opening. The transfer device may be movably installed at the body so as to be detachable through the opening. The at least one locking lever may be rotatably installed at the transfer device. The locking lever may rotate between a first position at which one end of the locking lever protrudes from the transfer device and a second position at which the one end is accommodated within the transfer device. The body may include a locking protrusion that is locked with other end of the locking lever in a state that the locking lever is at the first position.

The image forming apparatus may further include a lever spring configured to elastically support the locking lever such that the locking lever is maintained at the first position.

The image forming apparatus may further include one pair of guide members configured to guide separation of the transfer device while being disposed at opposite sides of inside the body, respectively. The guide member may include the locking protrusion and a rail part on which the transfer device is movably installed.

The transfer device may include an intermediate transfer belt on which toners are transferred in an overlapping manner, a driving roller and a driven roller that are disposed at opposite sides of inside of the intermediate transfer belt to rotate the intermediate transfer belt, and one pair of transfer device frames which are spaced apart from each other and to which both ends of each of the diving roller and the driven roller are rotatably installed. The at least one locking lever may include one pair of locking levers rotatably installed at the one pair of transfer device frames, respectively.

The locking lever may be provided at one end thereof with a button part protruding toward an upper side of the transfer device, provided at other end thereof with a locking part locked with the locking protrusion, and provided at a middle portion thereof with a hinge part such that the locking lever is rotatably installed at the transfer device frame.

The guide member may include a depression part provided in parallel to the locking protrusion such that the locking part is moved downward.

The transfer device frame may include an accommodation part in which the locking lever is accommodated, and a first through-hole provided at an upper side of the accommodation part so as to allow the button part to pass therethrough.

The transfer device may include a frame cover configured to cover the accommodation part, and the accommodation cover may include a second through-hole allowing the locking part to pass therethrough.

In accordance with an aspect, an image forming apparatus includes a body, a cover, a plurality of developing units, a transfer device and a sensing unit. The body may have an opening. The cover may open and close the opening. The plurality of developing units may be configured to develop an electrostatic latent image to a visible image through toner. The transfer device may be movably installed at the body so as to be detachable through the opening. The sensing unit may be disposed at a lower side of the transfer device to check toner transferred to the transfer device. The transfer device may be detached through the opening while being movably installed at an inside the body. The sensing unit may rotate while interacting with movement of the transfer device while being rotatably installed at the body.

The transfer device may include an intermediate transfer belt on which visible images are transferred from the plurality of developing units in an overlapping manner, and the sensing unit may check toner on the intermediate transfer belt.

The image forming apparatus may further include a cam member that is rotatably installed at one side of the sensing unit to allow the sensing unit to rotate according to movement of the transfer device.

The transfer device may include a driving roller and a driven roller that are disposed at opposite sides of inside of the intermediate transfer belt, and one pair of transfer device frames to which both ends of each of the diving roller and the driven roller are rotatably installed. The transfer device may include a protrusion part protruding downward to interact with the cam member.

The cam member may include a cam part formed to be locked with the protrusion part according to the movement of the transfer device.

The sensing unit may include first hinge shafts formed at both side ends thereof, respectively, such that the sensing unit is rotatably installed at the body, and a second hinge shaft spaced apart from the first hinge shaft in parallel to the first hinge shaft such that the cam member is rotatably installed at the second hinge shaft. The cam member may include a hinge hole allowing the second hinge shaft to pass therethrough for installation.

The body may include a body frame on which the sensing unit is rotatably installed. The image forming apparatus may further include a sensor spring configured to elastically support the sensing unit such that one side of the sensing unit is maintained in a state of being supported by the body frame.

As is apparent from the above description, only in a state that a worker operates the locking lever while gripping the transfer device frame of the transfer device, the transfer device is separated from the body, thereby separating the transfer device in a safe manner.

In addition, the sensing unit rotates by movement of the transfer device, thereby preventing the sensing unit from making friction with the transfer device in a process of detaching and attaching the transfer device.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
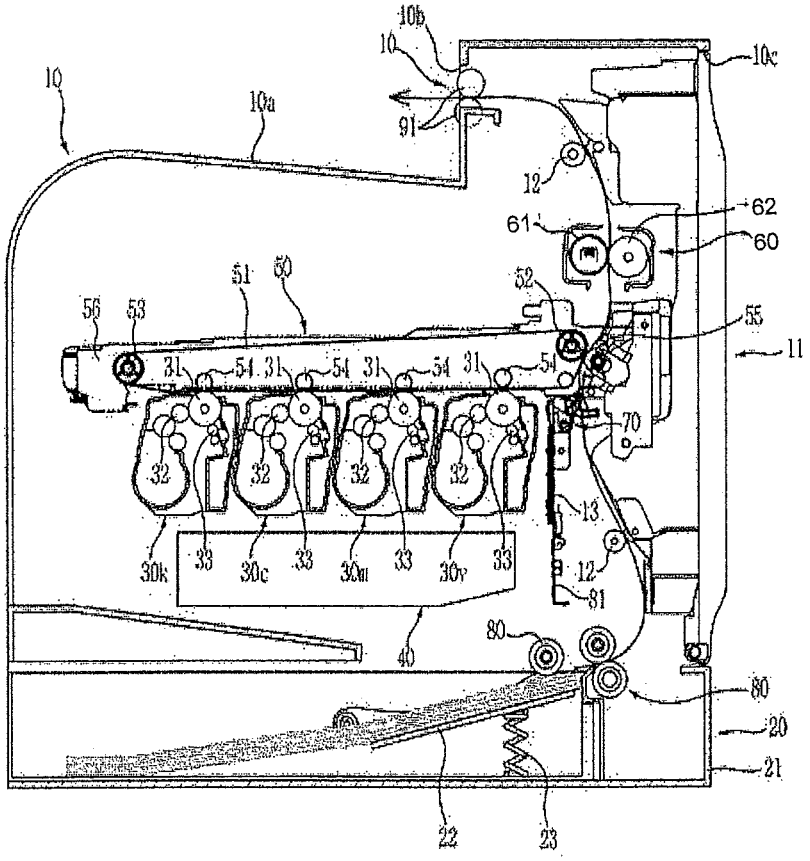
FIG. 1 is a cross sectional view of an image forming apparatus in accordance with an embodiment.

Reference will now be made in detail to the embodiments, examples of which are illustrated in the accompanying drawings, wherein like reference numerals refer to like elements throughout.

Referring to FIG. 1, an image forming apparatus in accordance with an embodiment includes a body 10 forming the external appearance of the image forming apparatus, a printing medium storage unit 20 to store printing medium, a plurality of developing units 30C, 30M, 30Y and 30K to develop electrostatic latent images to visible images according to colors by use of toner, an exposure unit 40 to form electrostatic latent images by irradiating light onto photoconductors 31 of the charged developing units 30C, 30M and 30Y and 30K, a transfer device 50 to receive a printing medium from the printing medium storage unit 20 and transfer the visible image formed on the photoconductors 31 to the printing medium, a fusing unit 60 to fix the toner, which is transferred to the printing medium, to the printing medium, and a sensing unit 70 to check the toner on the intermediate transfer belt 51 of the transfer device 50.

The body 10 is provided at an upper portion thereof with a loading part 10*a* on which the printing medium completed with the image formation is loaded, and a discharge port 10*b* is provided at one side of the loading part 10*a* to allow the printing medium completed with the image formation to be discharged therethrough. In addition, an opening 10*c* is provided at one side of the body 10 to repair components or replace expendable materials of an inside the body 10, and a side cover 11 is installed to open and close the opening 10*c*. In accordance with an embodiment of the present disclosure, the side cover 11 has a lower end rotatably installed at the body 10 so as to open and close the opening 10*c* while rotating on the lower end thereof.

The printing medium storage unit 20 includes a printing medium cassette 21 movably installed at the body 10, a knock-up plate 22 to load the printing media while being disposed in the printing medium cassette 21, and an elastic member 23 to elastically support the knock-up plate 22.

Each of the developing units 30C, 30M, 30Y and 30K includes a photoconductor 31, on a charged surface of which an electrostatic latent image is formed by the exposure unit 40, a developing roller 32 to supply toner to the photoconductor 31, and a charging unit 33 to charge the surface of the photoconductor 31.

The developing units 30C, 30M, 30Y and 30K in accordance with the embodiment of the present disclosure include four developing units 30C, 30M, 30Y and 30K each storing one of toners of cyan C, magenta M, yellow Y and black K at an inside thereof, to develop one of cyan C, magenta M, yellow Y and black K colors. The four developing units 30C, 30M, 30Y and 30K are disposed at a lower side of the transfer device 50.

The exposure unit 40 forms the electrostatic latent images on the surfaces of the photoconductors 31 by irradiating including image information to the photoconductors 31 provided at the developing units 30C, 30M, 30Y and 30K, respectively.

The transfer device 50 includes an intermediate transfer belt 51 on which visible images developed on the photoconductors 31 of the developing units 30C, 30M, 30Y and 30*k* are transferred in an overlapping manner, a driving roller 52 and a driven roller 53 disposed at opposite sides of inside the intermediate transfer belt 51 to rotate the intermediate transfer belt 51, a plurality of first transfer rollers 54 disposed opposite to the photoconductors 31 of the developing units 30C, 30M, 30Y and 30K, respectively, while interposing the intermediate transfer belt 51 therebetween, such that the visible images formed on the photoconductors 31 are transferred to the intermediated transfer belt 51, and transfer device frames 56 on which both ends of each of the first transfer rollers 54, the driving roller 52 and the driven droller 53 are rotatably installed.

Meanwhile, a second transfer roller 55 is disposed at the side cover opposite to the driving roller 52 while interposing the intermediate transfer belt 51 therebetween, to press the printing medium toward the intermediate transfer belt 51 to transfer the visible image of the intermediate transfer belt 51 to the printing media.

The fusing unit 60 includes a heating roller 61 to generate heat, and a pressing roller 62, an outer circumferential surface of which is formed of elastically deformable material to press the printing medium onto an outer circumferential surface of the heating roller 61.

In addition, at the body 10, a pick-up unit 80 is disposed at an upper side of the printing medium storage unit 20 to pick up the printing media loaded on the knock-up plate 22 one by one, a delivery roller 12 to guide the printing medium, which is picked up by the pick-up unit 80, upward, and a discharge unit 90 disposed at an upper side of the fusing unit 60 while being adjacent to the discharge port 10*b* to allow the printing medium passing through the fusing unit 60 to be discharged through the discharge port 10*b*. The pick-up unit 80 includes a pick-up roller 81 to pick up the printing media located on the knock-up plate 22 one by one, and the discharge unit 90 includes one pair of discharge rollers 91 disposed at an inside the discharge port 10*b*.

In addition, frames are provided at the body 10 to install and support the above described elements, and the frames include a body frame 13 that is disposed at a lower side of inside the opening 10*c* such that the sensing unit 70 is installed thereon.

Figure 2:
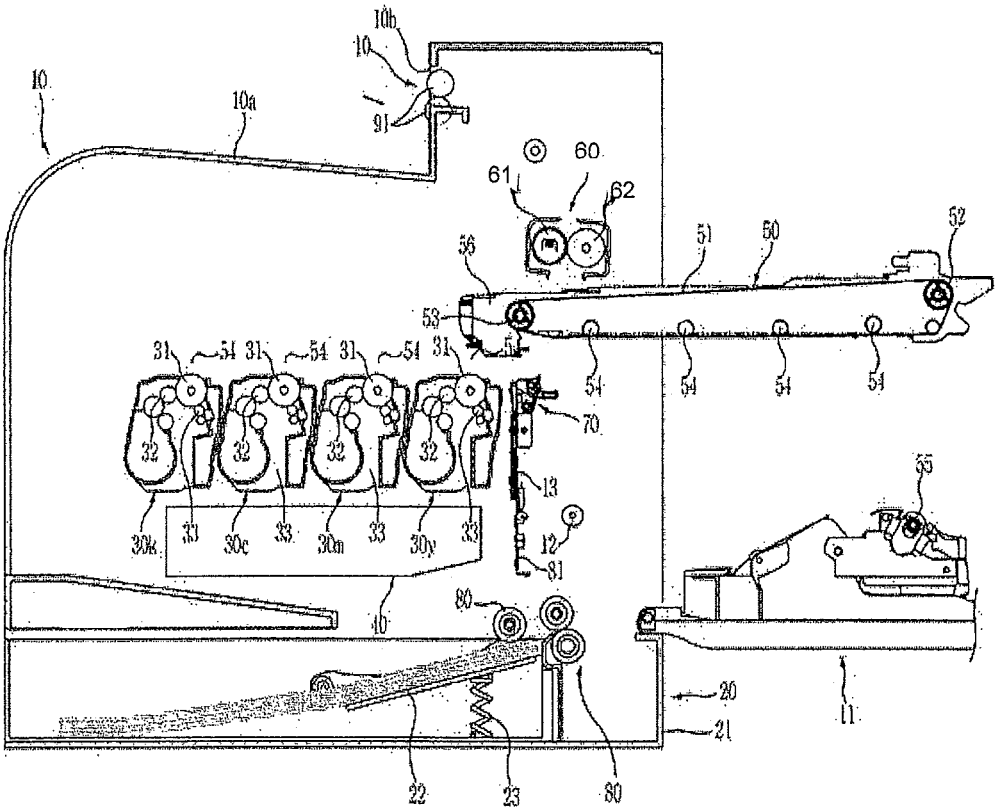
FIG. 2 is a cross sectional view of a process in which a transfer device is separated in the image forming apparatus in accordance with an embodiment.
Figure 3:
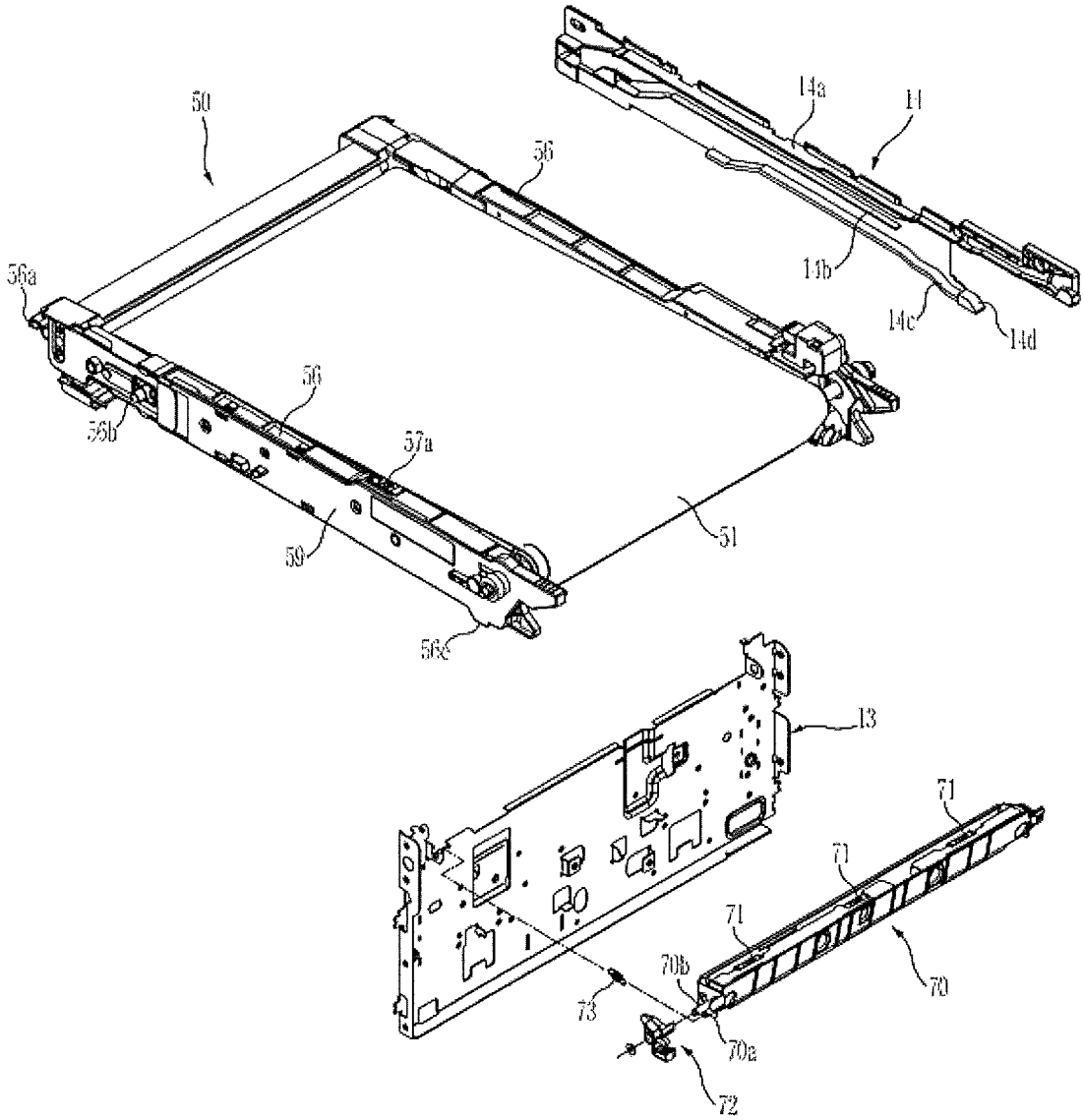
FIG. 3 is an exploded perspective view illustrating an installation state of a transfer device and a sensor unit in the image forming apparatus in accordance with an embodiment.
Figure 4:
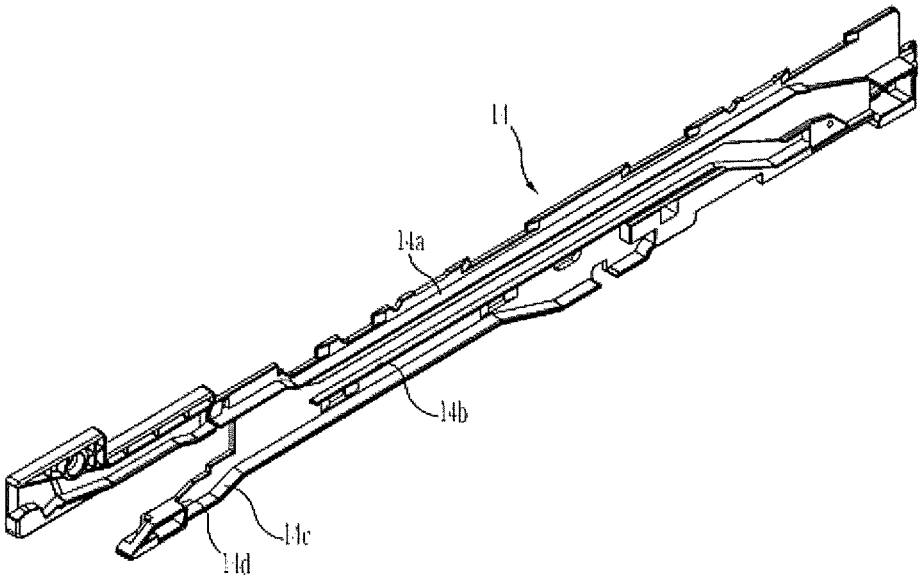
FIG. 4 is a perspective view illustrating a guide member in the image forming apparatus in accordance with an embodiment.

Referring to FIGS. 2 to 4, the transfer device 50 is detachably installed at the body 10 so as to be removable from the body 10 through the opening 10*c*. One pair of guide protrusions 56*a* and 56*b* are provided at each of the transfer device frames 56, and one pair of guide members 14 each having rail parts 14*a* and 14*b* are disposed at each of opposite sides of inside of the body 10. In accordance with this embodiment, one pair of guide protrusions 56*a* and 56*b* are provided at each of the transfer device frames 56, and one pair of rail parts 14*a* and 14*b* are disposed in parallel to each other in a upper and lower side direction.

Figure 5:
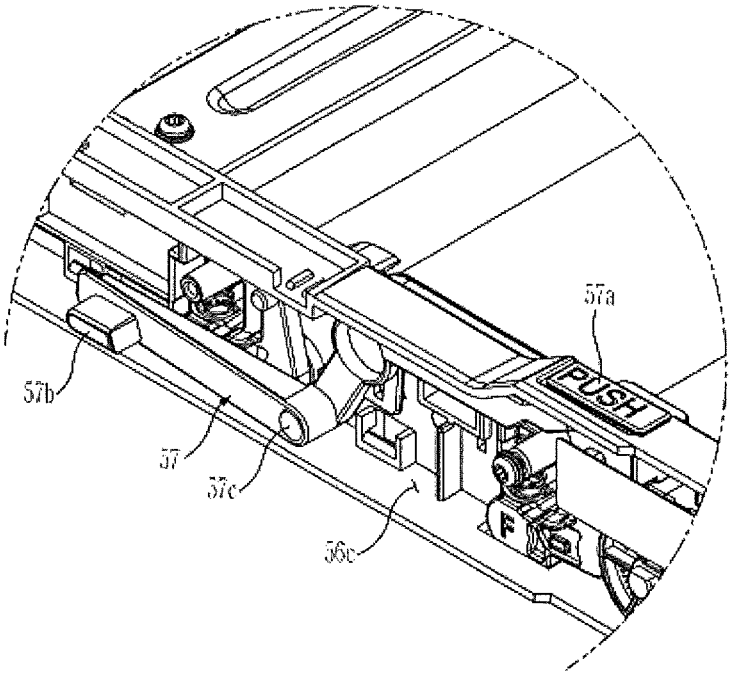
FIG. 5 is a perspective view illustrating an installation state of a locking member in the image forming apparatus in accordance with an embodiment.
Figure 6:
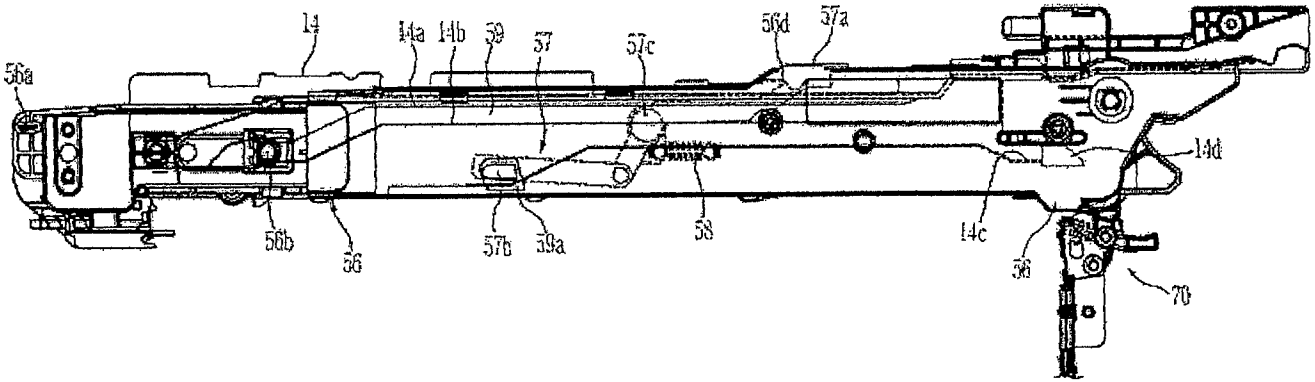
FIGS. 6 to 9 are side views illustrating an operation of a locking lever when a transfer device is separated in the image forming apparatus in accordance with an embodiment.

Referring to FIGS. 5 and 6, the transfer device 50 includes a locking lever 57 configured to enable a worker to separate the transfer device 50 from the body 10 in a safe manner, and a lever spring 58 configured to elastically support the locking lever 57 to maintain the locking lever 57 in a state of being rotated in one direction.

The locking lever 57 is rotatably installed at one of the two transfer device frames 56 of the transfer device 50 so as to be rotatable between a first position at which one end of the locking lever 57 protrudes from the transfer device 50 and a second position at which the one end of the locking lever 57 is accommodated within the transfer device 50.

The one end of the locking lever 57 protruding from the transfer device 50 is provided with a button part 57*a* to which a worker applies force to rotate the locking lever 57, and the other end of the locking lever 57 is provided with a locking part 57*b* configured to be locked with the guide member 14 to limit the movement of the transfer device 50, and a hinge part 57*c* formed in a middle portion of the locking lever 57 such that the locking lever 57 is rotatably installed at the transfer device frame 56.

The lever spring 58 elastically supports the locking lever 57 such that the locking lever 57 is rotated to the first position and is maintained at the first position.

For installation of the locking lever 57, an accommodation part 56*c* is provided at one side of the transfer device frame 56, and an accommodation part cover 59 is installed at the transfer device frame 56 to cover and hide the accommodation part 56*c*. A first through-hole 56*d* allowing the button part 57*a* to pass therethrough is provided at an upper surface of the transfer device frame 56, and a second through-hole 59*a* allowing the locking part 57*b* to pass therethrough is provided at the accommodation part cover 59.

Referring to FIG. 4, the guide member 14 is provided at a lower portion thereof with a depression part 14*c* depressed downward such that the locking part 57*b* is moved downward according to movement of the transfer device 50, and a locking protrusion 14*d* which is provided in line with the depression part 14*c* and to which the locking part 57*b* of the locking lever 57 is locked.

Figure 7:
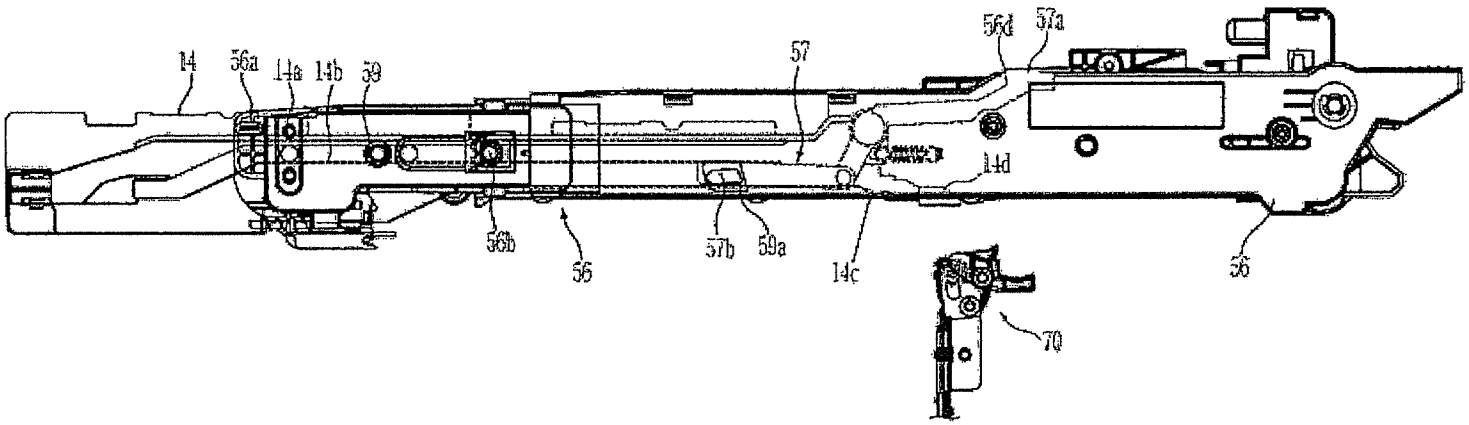
Figure 8:
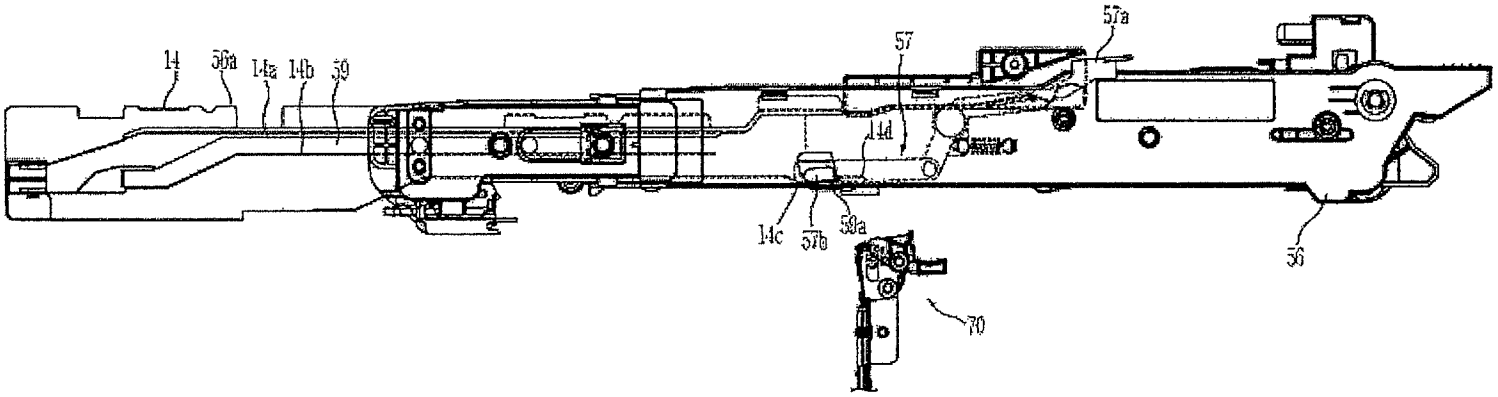

Accordingly, in a state in which the transfer device 50 is installed at an inside the body as shown in FIG. 6, when a user pulls the transfer device 50 to the outside the opening 10*c* through the opening 10*c* to separate the transfer device 50, the transfer device 50 is guided by the rail parts 14*a* and 14*b* of the guide member 14 and moved as shown in FIG. 7, and if the locking part 57*b* reaches the position of the depression part 14*c* as shown in FIG. 8, the locking lever 57 is rotated from the second position to the first position by the elastic restoring force of the lever spring 58, and thus button part 57*a* protrudes to the upper side of the first through-hole 56*d* and the locking part 57*b* moves downward to enter the inside of the depression part 14*c*. In this manner, the locking part 57*b* entering the inside of the depression part 14*c* is locked with the locking protrusion 14*d*, thereby limiting the movement of the transfer device 50.

Figure 9:
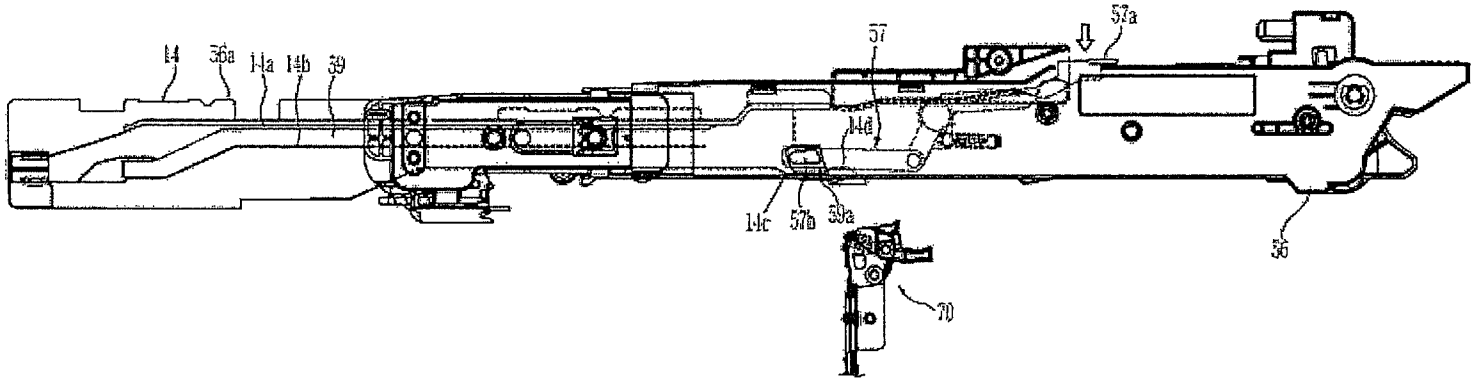

In order to move the transfer device 50 again, the locking part 57*b* needs to be separated from the depression part 14*c* be moving upward. Accordingly, a worker needs to press the button part 57*a* while gripping the transfer device frame 56 of the transfer device 50, and if the worker presses the button part 57*a*, the locking lever 57 is rotated from the first position to the second position as shown in FIG. 9, and accordingly, the locking part 57*b* is separated from the depression part 14*c*, thereby enabling the transfer device 50 to be moved again.

Accordingly, when the worker pulls the transfer device 50 to the outside of the opening 10*c*, the transfer device 50 is withdrawn through the opening 10*c* and is completely separated from the body 10.

In a process of withdrawing the transfer device 50 as the above, the worker needs to maintain a state of having the button part 57*a* pressed while gripping the transfer device frame 56, so that the worker needs to withdraw the transfer device 50 in a state of gripping the transfer device frame 56. Accordingly, the worker may separate the transfer device 50 from the body 10 in a safe manner.

Figure 10:
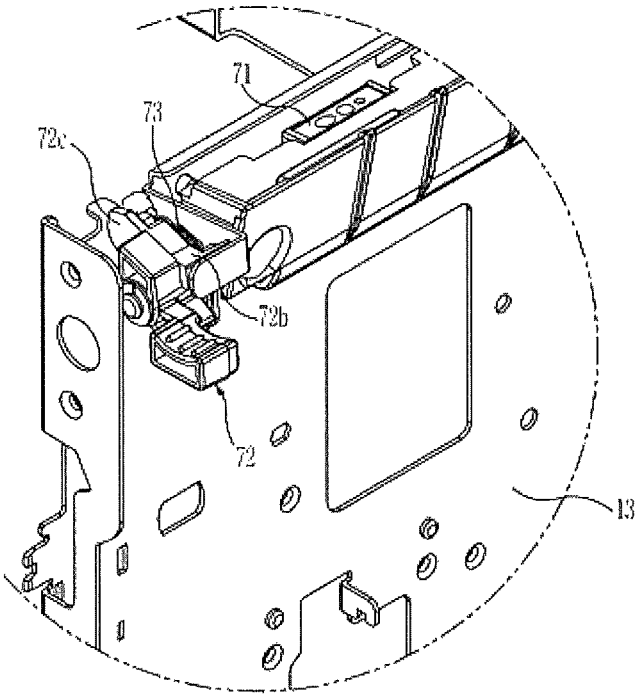
FIG. 10 is a perspective view illustrating an installation state of a sensor unit in the image forming apparatus in accordance with an embodiment.
Figure 11:
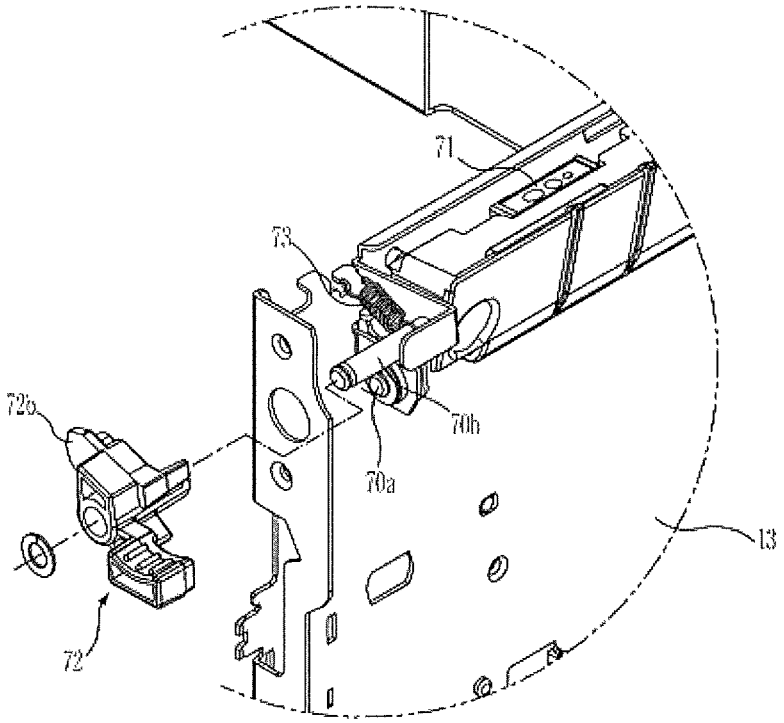
FIG. 11 is an exploded perspective view illustrating an installation state of a sensor unit in the image forming apparatus in accordance with an embodiment.

Referring to FIGS. 10 and 11, the sensing unit 70 includes a sensor 71 disposed opposite to the intermediate transfer belt 51 to check the toner on the intermediate transfer belt 51. In this embodiment of the present disclosure, three sensors 71 are provided and disposed while being spaced apart from one other in a width direction of the intermediate transfer belt 51.

The sensing unit 70 is disposed at a lower side of the transfer device 50, and rotatably installed at the body frame 13 so as to be rotated according to the movement of the transfer device 50. Such a configuration enables the sensing unit 70 to be disposed adjacent to the intermediate transfer belt 51 while preventing the sensing unit 70 from being in friction with the intermediate transfer belt 51 upon detaching the transfer device 50.

In order for the sensing unit 70 to rotate while interacting with the movement of the transfer device 50, a cam member 72 is rotatably installed at one side of the sensing unit 70. In addition, in order to maintain the sensing unit 70 in a state of having the sensor 71 disposed opposite the intermediate transfer belt 51 when an external force does not exert, a sensor spring 73 is provided to elastically support the sensing unit 70 toward the body frame 13. The sensor spring 73 has one end connected to a second hinge shaft 70*b*, which is to be described later, and the other end connected to the body frame 13.

Meanwhile, a protrusion part 56*e* protrudes downward from a lower portion of one side end of the transfer device frame 56 adjacent to the opening 10*c*, and configured to interact with the cam member 72 while making contact with the cam member 62 according to movement of the transfer device 50.

First hinge shafts 70*a* are provided at both ends of the sensing unit 70, respectively, so that the sensing unit 70 is rotatably installed at the body frame 13. The sensing unit 70 is provided at one of both side ends thereof with a second hinge shaft 70*b* that is formed while being spaced apart from the first hinge shaft 70*a* in parallel to the first hinge shaft 70*a* such that the cam member 72 is rotatably installed at the second hinge shaft 70*b*.

The cam member 72 includes a hinge hole 72*a* allowing the second hinge shaft 70*b* to pass therethrough for installation, and a cam part 72*b* protruding toward the body frame 13 so as to be locked with the protrusion part 56*e* of the transfer device frame 56 according to movement of the transfer device 50.

Figure 12:
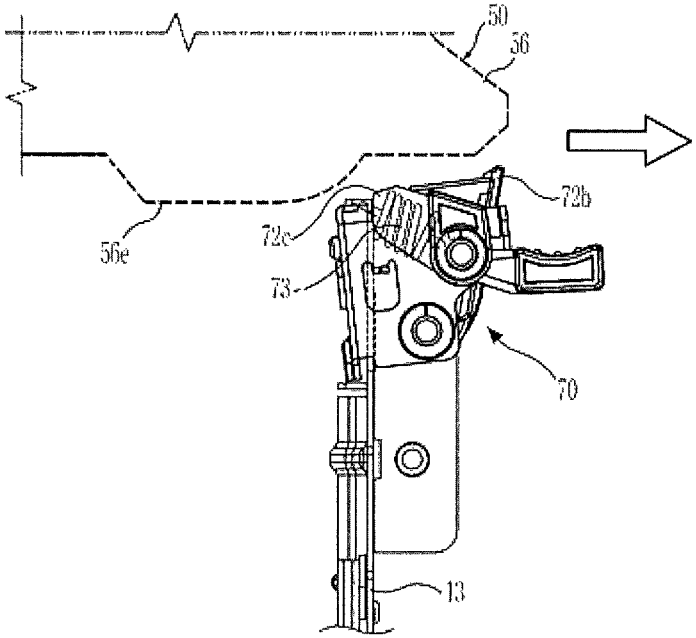
FIGS. 12 and 13 are side views illustrating an operation of a sensor unit when a transfer device is separated from a body in the image forming apparatus in accordance with an embodiment.
Figure 13:
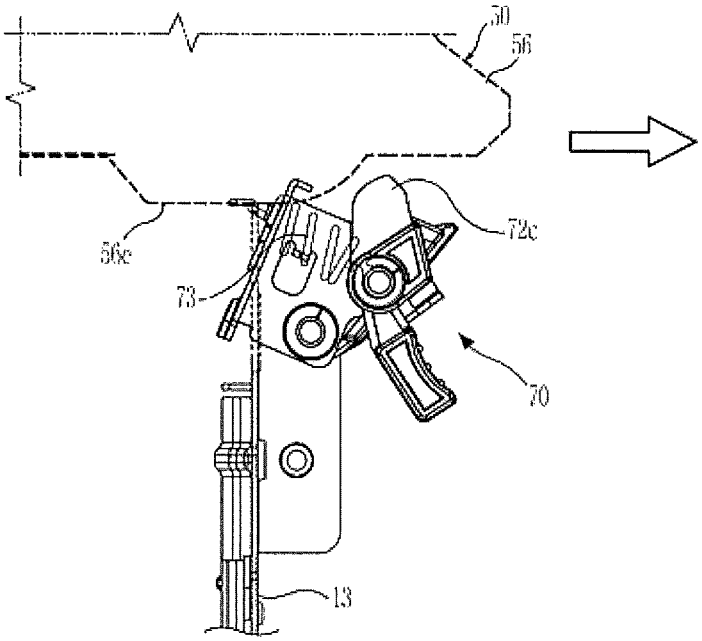

Accordingly, when a worker pulls the transfer device 50 to the outside the opening 10*c* to withdraw the transfer device 50 from the body 10, the protrusion part 56*e* provided on the transfer device frame 56 applies force to the inner side of the cam part 72*b* of the cam member 72 as shown in FIG. 12 and thus the cam member 72 rotates clockwise as shown in FIG. 13 to cause the sensing unit 70 to rotate on the first hinge shaft 70*a* clockwise. According to the rotation of the sensing unit 70, the upper surface of the sensing unit 70 becomes spaced apart from the lower surface of the transfer device 50, so that the sensing unit 70 is prevented from making contact with the intermediate transfer belt 51 when the transfer device 50 is separated from the body 10.

Figure 14:
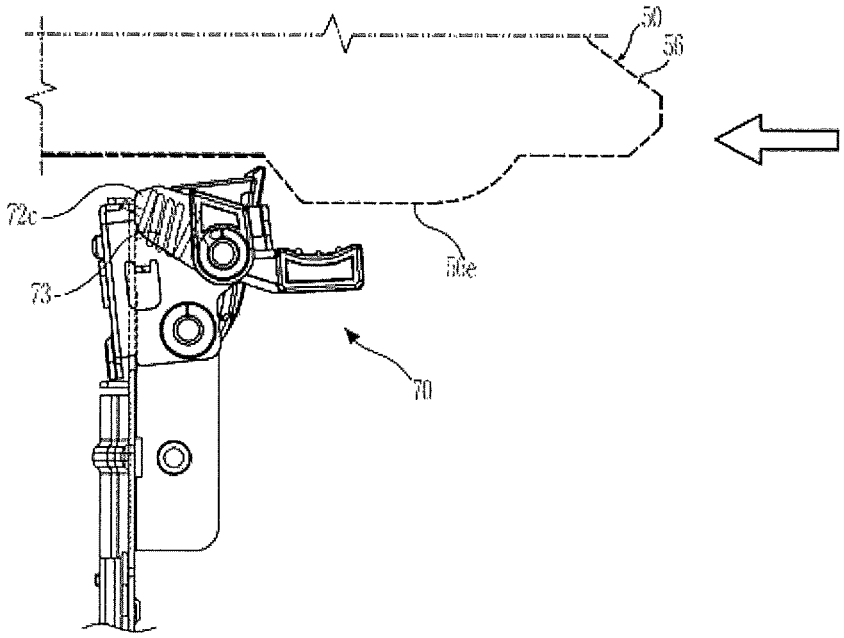
FIGS. 14 and 15 are side views illustrating an operation of a sensor unit when a transfer device is installed on a body in the image forming apparatus in accordance with an embodiment.
Figure 15:
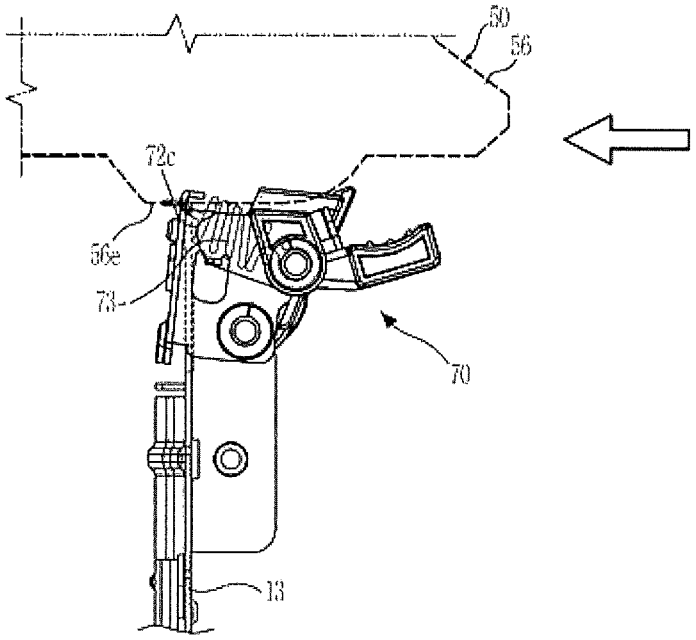

On the contrary, when the worker pushes the transfer device 50 to the inside the opening 10*c* to install the transfer device 50 in the body 10, as shown in FIG. 14, the protrusion part 56*e* provided on the transfer device frame 56 applies force to the outer side of the cam part 72*b* of the cam member 72, and thus the cam member 72 rotates toward the inside the opening 10*c*. As the cam member 2 rotates at a predetermined angle, the cam part 72*b* of the cam member 72 is supported by the body frame 13, and at this time, if the protrusion part 56*e* continues to transfer force through the cam part 72*b*, as shown in FIG. 15, the cam member 72 is rotated counterclockwise on the second hinge shaft 70*b* at the same time when the sensing unit 70 is rotated clockwise on the first hinge shaft 70*a*. According to the rotation of the sensing unit 70, the upper surface of the sensing unit 70 becomes spaced apart from the lower surface of the transfer device 50, so that the sensing unit 70 is prevented from making contact with the intermediate transfer belt 51 when the transfer device 50 is installed on the body 10.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a body provided at one side thereof with an opening;

a transfer device movably installed at the body so as to be detachable through the opening; and at least one locking lever rotatably installed at the transfer device, wherein the locking lever rotates between a first position at which one end of the locking lever protrudes from the transfer device and a second position at which the one end is contained within the transfer device body, and the body comprises a locking protrusion that is locked with other end of the locking lever in a state that the locking lever is at the first position.

2. The image forming apparatus of claim 1, further comprising a lever spring configured to elastically support the locking lever such that the locking lever is maintained at the first position.

3. The image forming apparatus of claim 1, further comprising:

one pair of guide members configured to guide separation of the transfer device while being disposed at opposite sides of inside the body, respectively, wherein the guide member comprises the locking protrusion and a rail part on which the transfer device is movably installed.

4. The image forming apparatus of claim 1, wherein the transfer device comprises an intermediate transfer belt on which toners are transferred in an overlapping manner, a driving roller and a driven roller that are disposed at opposite sides of inside of the intermediate transfer belt to rotate the intermediate transfer belt, and one pair of transfer device frames which are spaced apart from each other and to which both ends of each of the driving roller and the driven roller are rotatably installed, and the at least one locking lever comprises one pair of locking levers rotatably installed at the one pair of transfer device frames, respectively.

5. The image forming apparatus of claim 4, wherein at least one locking lever is provided at one end thereof with a button part protruding toward an upper side of the transfer device, provided at the other end thereof with a locking part locked with the locking protrusion, and provided at a middle portion thereof with a hinge part such that the locking lever is rotatably installed at the transfer device frame.

6. The image forming apparatus of claim 5, wherein the guide member comprises a depression part provided in parallel to the locking protrusion such that the locking part is moved downward.

7. The image forming apparatus of claim 5, wherein the transfer device frame comprises an accommodation part in which the locking lever is accommodated, and a first through-hole provided at an upper side of the accommodation part so as to allow the button part to pass therethrough.

8. The image forming apparatus of claim 7, wherein the transfer device comprises a frame cover configured to cover the accommodation part, and the accommodation cover comprises a second through-hole allowing the locking part to pass therethrough.

9. An image forming apparatus comprising:

a body having an opening;

a cover to open and close the opening;

a plurality of developing units configured to develop an electrostatic latent image to a visible image through toner;

a transfer device movably installed at the body so as to be detachable through the opening; and a sensing unit disposed at a lower side of the transfer device to check toner transferred to the transfer device, wherein the transfer device is detached through the opening while being movably installed at an inside the body, and the sensing unit rotates while interacting with movement of the transfer device while being rotatably installed at the body.

10. The image forming apparatus of claim 9, wherein the transfer device comprises an intermediate transfer belt on which visible images are transferred from the plurality of developing units in an overlapping manner, and the sensing unit checks toner on the intermediate transfer belt.

11. The image forming apparatus of claim 10, further comprising a cam member that is rotatably installed at one side of the sensing unit to allow the sensing unit to rotate according to movement of the transfer device.

12. The image forming apparatus of claim 11, wherein the transfer device comprises a driving roller and a driven roller that are disposed at opposite sides of inside of the intermediate transfer belt, and one pair of transfer device frames to which both ends of each of the driving roller and the driven roller are rotatably installed, and the transfer device comprises a protrusion part protruding downward to interact with the cam member.

13. The image forming apparatus of claim 12, wherein the cam member comprises a cam part formed to be locked with the protrusion part according to the movement of the transfer device.

14. The image forming apparatus of claim 11, wherein the sensing unit comprises first hinge shafts formed at both side ends thereof, respectively, such that the sensing unit is rotatably installed at the body, and a second hinge shaft spaced apart from the first hinge shaft in parallel to the first hinge shaft such that the cam member is rotatably installed at the second hinge shaft, and the cam member comprises a hinge hole allowing the second hinge shaft to pass therethrough for installation.

15. The image forming apparatus of claim 9, wherein the body comprises a body frame on which the sensing unit is rotatably installed, and the image forming apparatus further comprises a sensor spring configured to elastically support the sensing unit such that one side of the sensing unit is maintained in a state of being supported by the body frame.

16. An image forming apparatus comprising:

a body having an opening;

a cover to open and close the opening;

a plurality of developing units configured to develop an electrostatic latent image to a visible image through toner;

a transfer device installed at the body so as to be detachable through the opening;

a frame disposed within the body to guide the movement of the transfer device as it is removed from or inserted into the body;

a locking lever disposed on the transfer device that interacts with the frame to lock the transfer device into position within the body;

a sensing unit that rotates in the direction of the movement of the transfer device as it is being detached or inserted into the body, wherein the locking lever rotates between a first position at which one end of the locking lever protrudes from the transfer device and a second position at which the one end is contained within the transfer device body.

17. The image forming apparatus of claim 16, wherein the frame comprises a locking protrusion that is locked with the other end of the locking lever in a state that the locking lever is at the first position.

18. The image forming apparatus of claim 17, wherein the frame further comprises:

one pair of guide members configured to guide separation of the transfer device while being disposed at opposite sides of inside the body, respectively, wherein the guide member comprises the locking protrusion and a rail part on which the transfer device is movably installed.

19. The image forming apparatus of claim 16, further comprising a cam member that is rotatably installed at one side of the sensing unit to allow the sensing unit to rotate according to movement of the transfer device.

20. The image forming apparatus of claim 19, wherein the sensing unit comprises first hinge shafts formed at both side ends thereof, respectively, such that the sensing unit is rotatably installed at the body, and a second hinge shaft spaced apart from the first hinge shaft in parallel to the first hinge shaft such that the cam member is rotatably installed at the second hinge shaft, and the cam member comprises a hinge hole allowing the second hinge shaft to pass therethrough for installation.

* * * * *